US005315716A

United States Patent [19]

Baum

[11] Patent Number: 5,315,716

[45] Date of Patent: May 31, 1994

[54] EASILY REMOVABLE AND DONNABLE PANTS

[76] Inventor: Gregory H. Baum, 92 Greenridge Ct., Lake Oswego, Oreg. 97035

[21] Appl. No.: 983,377

[22] Filed: Nov. 30, 1992

[51] Int. Cl.[5] ..... A41D 1/06

[52] U.S. Cl. ..... 2/227; 2/228; 2/79; 2/114; 2/912

[58] Field of Search ..... 2/227, 228, 79, 114, 2/DIG. 6, DIG. 7; 24/306, 442, 445, 450

[56] References Cited

U.S. PATENT DOCUMENTS

| | | | |
|---|---|---|---|
| Re. 33,966 | 6/1992 | Robison . | |
| D. 231,155 | 4/1974 | Bowcut . | |
| 1,934,179 | 11/1933 | Fischer . | |
| 2,520,026 | 8/1950 | Beitchman | 2/227 |
| 2,571,202 | 10/1951 | Clyne . | |
| 2,627,604 | 2/1953 | Schor . | |
| 2,923,009 | 2/1960 | Cookman . | |
| 3,466,666 | 9/1969 | Otto . | |
| 3,711,865 | 1/1973 | Schifman . | |
| 3,800,330 | 4/1974 | Bowcut . | |
| 3,801,986 | 4/1974 | Purdon . | |
| 3,855,635 | 12/1974 | Ramirez . | |
| 4,068,315 | 1/1978 | Rainville . | |
| 4,258,440 | 3/1981 | McGowan . | |
| 4,422,186 | 12/1983 | Loney | 2/114 |
| 4,506,391 | 3/1985 | Rodman . | |
| 4,549,315 | 10/1985 | English et al. . | |
| 4,638,509 | 1/1987 | Charron . | |
| 4,644,589 | 2/1987 | Pettis . | |
| 4,651,353 | 3/1987 | Walden . | |
| 4,737,955 | 4/1988 | Wiley . | |
| 4,914,756 | 4/1990 | Grassick . | |
| 4,918,760 | 4/1990 | Grilliot et al. . | |
| 4,964,173 | 10/1990 | Gordon et al. | 2/114 |
| 4,977,622 | 12/1990 | Schley . | |
| 4,993,077 | 2/1991 | Robison . | |
| 5,008,962 | 4/1991 | Smith . | |
| 5,031,247 | 7/1991 | Carter . | |
| 5,033,126 | 7/1991 | Wruck et al. . | |
| 5,084,914 | 2/1992 | Hesch . | |
| 5,097,535 | 3/1992 | Dye et al. . | |

FOREIGN PATENT DOCUMENTS

| | | |
|---|---|---|
| 723921 | 10/1931 | France . |
| 1431107 | 1/1965 | France . |
| 2543802 | 4/1983 | France . |
| 2027330 | 2/1980 | United Kingdom . |

*Primary Examiner*—Clifford D. Crowder
*Assistant Examiner*—Gloria Hale
*Attorney, Agent, or Firm*—William A. Birdwell

[57] ABSTRACT

Easily removable and donnable pants. The pants employ a releasable seam along the outside of each leg and a plurality of separate hook and loop fastener segments distributed along the seam for closing the seam. The lowest fastener, at the bottom of the pant leg, offers less resistance than those above it. The highest fastener, at the waist of the pants, offers more resistance than those below it. The lowest and highest fasteners comprise tabs, to permit adjustment of the waist and ankles of the pants to the size of the wearer, while those in between preferably are wave shaped. Preferably, the waist and ankle are provided with elastic material to make those portions of the pants adjustable and snug.

12 Claims, 2 Drawing Sheets

EASILY REMOVABLE AND DONNABLE PANTS

BACKGROUND OF THE INVENTION

This invention relates to pants, particularly to pants for recreational use and for physically infirm or handicapped persons that are easy to don and remove.

In outdoor sporting events, such as soccer, the players ordinarily wear warm up pants when they are not actually in the game, or are travelling to and from the site of the game, in order to keep warm. This presents several problems. One problem is that when a player is called to enter the game the warm ups need to be removed rapidly so as not to hold up play. Another problem is that in outdoor sports the players shoes typically become covered with grass, dirt and even mud, which makes putting pants on after play without soiling the inside of the pants difficult, if not impossible.

Similarly, cross country skiers seek warmth until they have been active for a certain period. Then, they would like to reduce the layers of clothing and don them again when the skier slows down and cools off. However, this is difficult for a cross country skier to do with conventional ski pants because of the ski boots worn by the skier and the skis to which the boots are attached. Even pants with a full side zipper would be difficult to use because ski gloves must be removed and a small zipper manipulated.

One type of warm up pant which is often used by basketball players addresses the first problem by providing a releasable seam down the legs on the outside thereof, the seam being closed by a plurality of snap-type fasteners. However, this type of pant is not entirely satisfactory as a quick removal pant because the snaps do not release easily unless the pant is grasped near the snaps, which requires several unsnapping tugs, and each of typically about twenty snaps must be individually put together again to wear the pants. More importantly, these types of pants do not provide much relief from the problems of keeping the interior of the pants clean or preventing catching of the pants with cleats. This is because, as a practical matter, it is difficult to close the snaps after donning the pants. It is far easier to snap the pants together before donning them again, but that leads to soiling the inside of the pants with grass, dirt or mud from a player's shoes when the pants are donned or having the player's shoes catch on the inside of the pant leg.

Other types of pants which have releasable seams at least partly along the outside of the legs for convenience have been disclosed. For example, Purdon U.S. Pat. No. 3,801,986 discloses ski warm up pants that have a zipper along the outside seam of the legs for ease of removal. Similarly, Schifman U.S. Pat. No. 3,711,865 discloses an outer garment for cold weather which also has a zipper along the outside seam for ease of removal; however, this usually requires the removal of gloves to manipulate the zipper. Grilliot et al. U.S. Pat. No. 4,918,760 discloses fire fighter's trousers which have a seam with a zipper part of the way up each leg for permitting the trousers to be expanded at the bottom for donning the trousers with fireboots on. However, zippers running the length of a person's leg are awkward to manipulate, typically take several seconds to unzip, can be difficult to align for closing the pant, can jam by catching on adjacent material, may pinch the wearer's skin, often become untracked or otherwise fail. Moreover, while a seam part of the way up a pant helps to fit a boot through the pant, it does not prevent the inside of the pant from being snagged or soiled by dirty footwear when the pants are donned.

Pants have also been disclosed which have releasable seams along the legs thereof that include a continuous strip of hook and loop fastener material, such as that marketed under the trademark VELCRO® by Velcro USA. Some such pants have been designed for the convenience of persons having a physical infirmity or handicap. For example, Smith et al. U.S. Pat. No. 5,008,962 discloses pants with inseams closed by hook and loop material, and Grassick U.S. Pat. No. 4,914,756 discloses pants which have hook and loop material at the inseam and along the outer seam of only one leg. Neither of these arrangements places the seam in a convenient position for quick removal of the pants and, in any case, it is almost as difficult to unfasten and fasten a continuous strip of hook and loop material as a plurality of snaps. In addition, a continuous strip of hook loop material is relatively rigid, which limits the flexibility of the pant and makes the use of lightweight pant material impractical because it does not allow the fabric to assume its own shape.

Therefore, there is a need for improved pants suitable for recreational use, use as sports warm ups and for physically infirm or handicapped persons which decreases the time and inconvenience in removing and donning the pants.

SUMMARY OF THE INVENTION

The present invention solves the aforementioned problems of prior art pants and meets the aforementioned needs by providing easily removable and donnable pants that employ a releasable seam along the outside of each leg and a plurality of separate hook and loop fastener segments distributed along the seam for closing the seam. The lowest fastener, at the bottom of each pants leg, offers less resistance than those above it, and the highest fasteners, at the waist of the pants, offers more resistance than those below it. The lowest and highest fasteners are in the shape of rectangular tabs, to permit adjustment of the waist and bottom of the pants to the size of the wearer, while those in between preferably are wave shaped to optimize the flexibility of seam and maximize the mating surface for alignment purposes. Preferably, the waist and ankle are provided with elastic material to keep those portions snug.

Accordingly, it is a principal object of the present invention to provide novel and improved pants that are easy to remove and don.

It is another object of the present invention to provide pants that can be removed with only one tug at the waist of the pants.

It is a further object of the present invention to provide pants that can be donned by a person wearing soiled shoes without soiling the inside of the pant legs.

It is yet another object of the present invention to provide pants which can be donned by a person wearing cleated or other footwear which might otherwise catch or not fit through legs of conventional pants.

It is yet another object of the present invention to provide pants having a releasable seam along the outside of each leg that can be fastened in a single motion.

The foregoing and other objects, features and advantages of the invention will be more readily understood upon consideration of the following detailed description of the invention, taken in conjunction with the accompanying drawings.

DESCRIPTION OF THE PREFERRED EMBODIMENT

Figure 1:
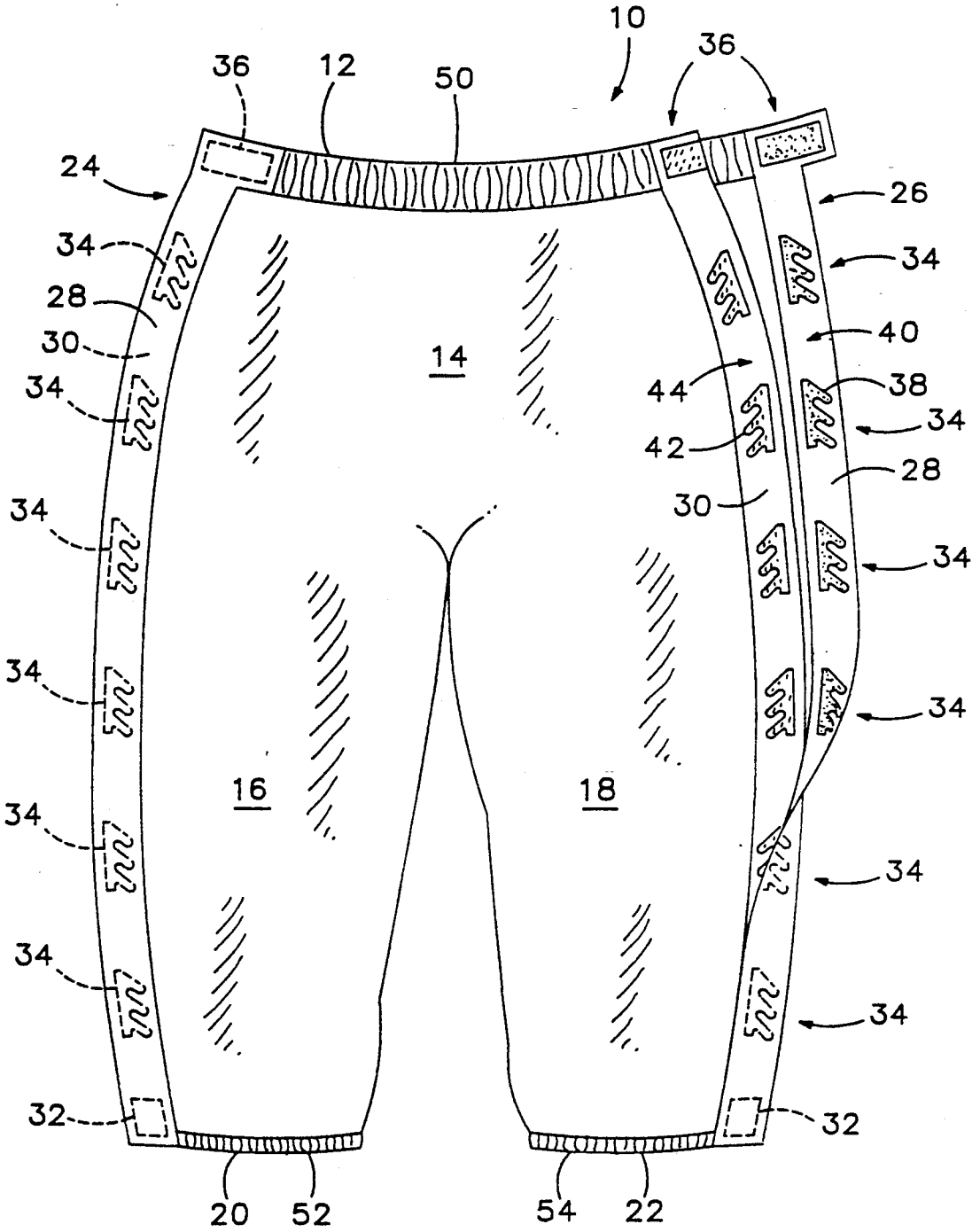
FIG. 1 is a back view of a preferred embodiment of pants according to the present invention.

Referring to FIG. 1, easily removable pants 10 according to the present invention have a waist 12, an upper portion 14 and two legs 16 and 18, terminating in respective lower ends 20 and 22. The upper portion and legs are made of some fabric or other material suitable for the particular purpose of the pants. As the pants are especially suitable for use as sports warm ups for outdoor sports, it is preferred that the pants be made of fleece, polyester, or some combination of the two which offers warmth and protection from wind and rain. However, other material may be used, particularly where the pants 10 are adapted for use by persons having a physical infirmity or handicap.

Each leg 16 and 18 of the pants has a releasable seam 24 and 26, respectively, along the outside thereof. That is, each leg of the pants is openable along a seam extending from the bottom end of the leg upwardly, preferably clear to the waist. Each such seam comprises a first part 28 which overlaps a second part 30 to close the seam. As explained hereafter, fasteners are provided to hold the first part to the second part and thereby close the seam. Preferably, the first and second parts of the seams are reinforced with one or more additional layers of a suitable material, as is commonly understood in the clothing industry, so as to prevent tearing when the pants are opened and to provide a foundation for mounting fasteners.

As FIG. 1 is a back view of the pants 10, it can be seen that in the preferred embodiment the first part 28 of each seam is disposed on the front of the pants and the second part 30 is disposed on the back of the pants. Consequently, during forward travel the first part 28 of the seam is less likely to catch on something and air is less likely to flow through the seam, which would reduce the warmth of the pants. Also, from the front, the seam is less noticeable.

Figure 2:
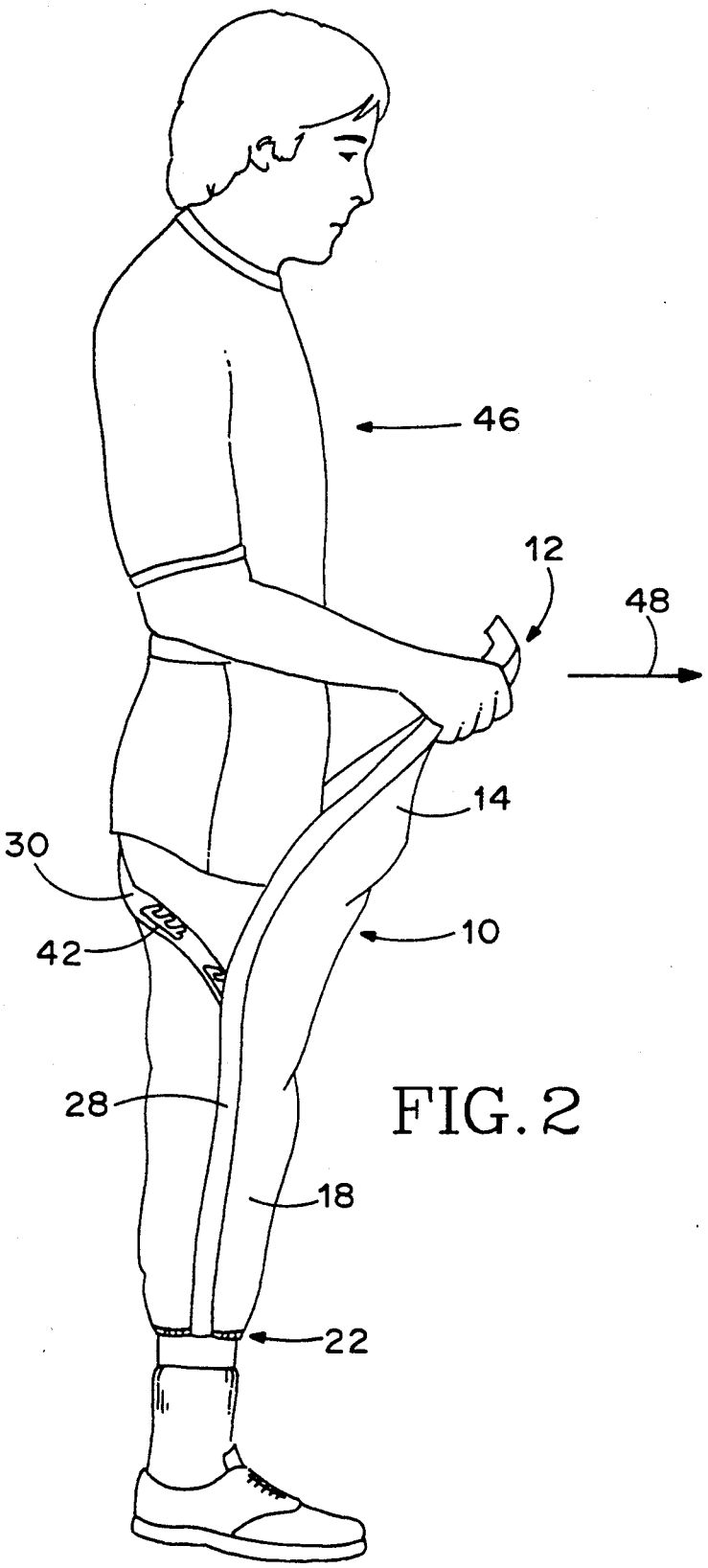
FIG. 2 is a side view of the preferred embodiment of pants according to the present invention, worn by a person who is in the process of removing the pants.

A plurality of hook and loop fastener segments 32, 34 and 36, or their equivalent, are disposed at intervals along each seam from the bottom end of the leg to the waist. Each such fastener segment has a hook portion 38, preferably mounted on the inside 40 of the first part 28 of each seam, and a loop portion 42, preferably mounted on the outside 44 of the second part 30 of each seam. Such fasteners are marketed under the trademark VELCRO ® by Velcro USA. Thence, as can be seen in FIG. 2, the pants can be worn by a person 46 by fastening corresponding hook and loop portions of the fasteners together with the legs of the pants wrapped around the legs of the person. When the pants are to be removed, the front waist adjacent the top of a seam is simply pulled away from the back waist, as shown by arrow 48, which causes the fasteners to release, ordinarily in sequence from the top to the bottom of the seam.

Preferably, the lowest fasteners 32 on each leg are chosen to offer less resistance to force than the higher fasteners 34 and 36, so as to release more readily. This is because the force to release the pants is applied at the waist, some distance from the bottom of the pants, which makes application of the same force at the bottom as at the top difficult and which minimizes stretching of the fabric. It has been found that the fasteners 34 will perform well if they all offer the same resistance to release, though they may be chosen to have increasing resistance from the bottom to the top with some advantage gained. The top fasteners 36 preferably have greater resistance than the fasteners 34, so as to ensure that the waist does not release inadvertently.

In order to provide greater flexibility of the pants along the seam, it is preferred that the fasteners 34 be of a type marketed under the trademark WAVELOCK ® by Velcro USA. In such fasteners the hook and loop portions are waveshaped, as shown in FIG. 1. On the other hand, the waist fasteners 36 and the ankle fasteners 32 preferably are rectangular in shape and are horizontally oriented to allow for adjustment to fit the waist size and ankle size of different people.

By way of example, it has been found that the following fastener characteristics work well:

- Waist hooks: 8 mil material, 330 hooks per square inch (Velcro model Hook 88);
- Waist loops: napped loop (Velcro model Loop 1000);
- Intermediate hooks: 8 mil material, 330 hooks per square inch, waveshaped (Velcro Wavelock model Hook 88);
- Intermediate loops: napped loop, waveshaped (Velcro Wavelock model Loop 1000);
- Ankle hooks: 6.5 mil material, 400 hooks per square inch, (Velcro model Hook 65); and
- Ankle loops: unnapped loop (Velcro model Loop 2000).

In addition, elastic material (not shown) is disposed within gathers 50 around the waist of the pants, and in gathers 52 and 54 around each of the ankles, respectively. This permits the pants to be adjusted snugly, yet comfortably to the size of the wearer.

In use, the pants maybe closed simply by grasping the two open sides of a seam at the ankle in one hand and likewise at the waist with the other hand and quickly pulling the two hands apart. The seam closes on itself and the hook and loop surfaces attach to one another. Thence, in a single motion, each pants leg can be "snapped" together. To reattach the pants on a person without having to pass feet, and dirty, cleated or oversize shoes, through the legs, the fabric need simply be draped around the legs and the hook and loop surfaces can easily be mated by sliding a hand along the outside of the seam. Only slight pressure is required to obtain closure and, in contrast to buttons, snaps or zippers, the alignment need not be exact to accomplish closure.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. Easily removable and donnable pants having a waist and two legs, comprising:

(a) pants having a releasable seam extending upwardly from the bottom end of each pant leg along the outside thereof, each said seam having two opposing, overlapping parts; and (b) a plurality of hook and loop fastener segments disposed along each said seam, the hook portion of each said fastener segment being disposed on one part of each said seam and the loop portion of each said fastener segment being disposed on the other part of each said seam to fasten said one part to said other part, wherein the lowest of said fasteners on each leg is constructed so as to require less force to release than one or more fasteners disposed higher on the same seam.

2. The pants of claim 1, wherein a plurality of said hook and loop fastener segments on each leg comprise wave-shaped hook and loop fasteners.

3. The pants of claim 2, wherein the highest and lowest fastener segment on each leg comprise rectangular shaped pieces.

4. The pants of claim 1, wherein each leg includes elastic material disposed around at least part of the bottom end thereof, and further comprising elastic material disposed around at least part of the waist thereof.

5. The pants of claim 3, wherein each leg includes elastic material disposed around at least part of the bottom end thereof, and further comprising elastic material disposed around at least part of the waist thereof.

6. The pants of claim 1, wherein the highest and lowest fastener segment on each leg comprise rectangular shaped pieces.

7. The pants of claim 6, wherein each leg includes elastic material disposed around at least part of the bottom end thereof, and further comprising elastic material disposed around at least part of the waist thereof.

8. The pants of claim 1, wherein each leg includes elastic material disposed around at least part of the bottom end thereof, and further comprising elastic material disposed around at least part of the waist thereof.

9. Easily removable and donnable pants having a waist and two legs, comprising:

(a) pants having a releasable seam extending upwardly from the bottom end of each pant leg along the outside thereof, each said seam having two opposing, overlapping parts; and (b) a plurality of hook and loop fastener segments disposed along each said seam, the hook portion of each said fastener segment being disposed on one part of each said seam and the loop portion of each said fastener segment being disposed on the other part of each said seam to fasten said one part to said other part, wherein for a plurality of said fasteners segments on each leg either the hook portion or the loop portion is waveshaped and wherein the highest and lowest fastener segment on each leg comprise rectangular shaped pieces.

10. The pants of claim 9, wherein each leg includes elastic material disposed around at least part of the bottom end thereof, and further comprising elastic material disposed around at least part of the waist thereof.

11. The pants of claim 9, wherein each leg includes elastic material disposed around at least part of the bottom end thereof, and further comprising elastic material disposed around at least part of the waist thereof.

12. Easily removable and donnable pants having a waist and two legs comprising:

(a) pants having a releasable seam extending upwardly from the bottom end of each pant leg along the outside thereof, each said seam having two opposing, overlapping parts; and (b) a plurality of hook and loop fastener segments disposed along each said seam, the hook portion of each said fastener segment being disposed on one part of each said seam and the loop portion of each said fastener segment being disposed on the other part of each said seam to fasten said one part to said other part, wherein for a plurality of said fastener segments on each leg either the hook portion or the loop portion is waveshaped and wherein the lowest of said fasteners on each leg is constructed so as to require less force to release than one or more fasteners disposed higher on the seam.

* * * * *